US009556643B2

(12) United States Patent
Saitou

(10) Patent No.: US 9,556,643 B2
(45) Date of Patent: Jan. 31, 2017

(54) EXTERNAL HANDLE DEVICE FOR VEHICLE DOOR

(75) Inventor: Tadashi Saitou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 463 days.

(21) Appl. No.: 14/119,489

(22) PCT Filed: Feb. 21, 2012

(86) PCT No.: PCT/JP2012/054052
§ 371 (c)(1),
(2), (4) Date: Nov. 22, 2013

(87) PCT Pub. No.: WO2012/164983
PCT Pub. Date: Dec. 6, 2012

(65) Prior Publication Data

US 2014/0117683 A1 May 1, 2014

(30) Foreign Application Priority Data

May 27, 2011 (JP) ..... 2011-118615

(51) Int. Cl.
*E05B 3/00* (2006.01)
*E05B 1/00* (2006.01)
(Continued)

(52) U.S. Cl.
CPC ..... *E05B 1/003* (2013.01); *E05B 79/06* (2013.01); *E05B 81/76* (2013.01); *E05B 85/16* (2013.01); *Y10T 292/57* (2015.04)

(58) Field of Classification Search
CPC ..... E05B 1/003; E05B 79/06; E05B 81/76; E05B 81/77; E05B 81/78; E05B 85/10; E05B 85/14; E05B 85/16; E05B 85/18
(Continued)

(56) References Cited

U.S. PATENT DOCUMENTS 7,217,899 B2 5/2007 Hidaka et al.
7,559,120 B2 7/2009 Fujiwara et al.
(Continued)

FOREIGN PATENT DOCUMENTS

CN 101275444 A 10/2008
CN 101892768 A 11/2010
(Continued)

OTHER PUBLICATIONS

Official Communication dated Dec. 24, 2014 issued in the corresponding CN Patent Application 201280025733.X.

*Primary Examiner* — Alyson M Merlino
(74) *Attorney, Agent, or Firm* — Carrier Blackman & Associates, P.C.; Joseph P. Carrier; Anne G. Sabourin

(57) ABSTRACT

An external handle device for a vehicle door has one end part of an operating handle supported by a support member mounted on a door having one end part supported on a vehicle body, and a holder for housing and holding an electrical component mounted on a base member. A mounting portion mounted on an end wall on the other end side of the door has a mounting hole obliquely intersecting an outer panel and is provided integrally with the base member, an engagement hole extending along the axis of the mounting hole and having one end opening in a blocked part at the inner end of the mounting hole is provided in the mounting portion so that the other end opens on the periphery of the mounting portion, and an engagement projection that engages with the other end part of the engagement hole is provided on a holder.

17 Claims, 10 Drawing Sheets

(51) Int. Cl.
*E05B 79/06* (2014.01)
*E05B 81/76* (2014.01)
*E05B 85/16* (2014.01)

(58) Field of Classification Search
USPC 340/425.5, 5.62, 5.72; 70/262–266; 292/92, 292/336.3, DIG. 65
See application file for complete search history.

(56) References Cited

U.S. PATENT DOCUMENTS

| | | | | |
|---|---|---|---|---|
| 8,359,712 | B2 | 1/2013 | Saitou et al. | |
| 8,833,810 | B2 | 9/2014 | Koizumi et al. | |
| 2001/0022266 | A1* | 9/2001 | Benard | E05B 85/16 200/61.64 |
| 2005/0236846 | A1* | 10/2005 | Hidaka | H03K 17/962 292/216 |
| 2006/0226953 | A1* | 10/2006 | Shelley | B60R 25/00 340/5.62 |
| 2007/0075828 | A1* | 4/2007 | Mizushima | B60R 25/246 340/5.62 |
| 2012/0166023 | A1* | 6/2012 | Hara | E05B 85/16 701/2 |

FOREIGN PATENT DOCUMENTS

| | | | | |
|---|---|---|---|---|
| FR | 2799491 | A1 * | 4/2001 | E05B 79/06 |
| GB | WO 0202893 | A1 * | 1/2002 | E05B 81/78 |
| JP | 2000-145228 | A | 5/2000 | |
| JP | 2005-009216 | A | 1/2005 | |
| JP | 3639292 | B1 * | 4/2005 | E05B 81/78 |
| JP | 2005-256453 | A | 9/2005 | |
| JP | WO 2005124066 | A1 * | 12/2005 | B60R 25/24 |
| WO | 2010/067870 | A1 | 6/2010 | |

* cited by examiner

EXTERNAL HANDLE DEVICE FOR VEHICLE DOOR

TECHNICAL FIELD

The present invention relates to an external handle device for a vehicle door, the external handle device including an operating handle having a grip portion that is formed so as to be long and is disposed outside an outer panel forming part of a door having one end part pivotably supported on a vehicle body, a support member that is mounted on the door so as to pivotably support one end part of the operating handle, a base member that is made of a synthetic resin and is mounted on the door so as to correspond to the other end part the operating handle, and a holder that is mounted on the base member so as to house and hold an electrical component.

BACKGROUND ART

A structure in which a switch that is turned ON/OFF by an operation of locking a door by a vehicle user is secured and fixed by two mounting screws to a base member mounted on a door panel is known from Patent Document 1.

RELATED ART DOCUMENTS

Patent Documents

Patent Document 1: Japanese Patent Application Laid-open No. 2000-145228

SUMMARY OF INVENTION

Problems to be Solved by the Invention

However, in the structure disclosed by Patent Document 1 above, the number of components or the number of assembly steps for fixing the switch to the base member is large, thus giving rise to the problem that the cost increases.

Consideration could therefore be given to forming an engagement hole in the base member, engaging a holder with the engagement hole so as to carry out provisional positioning, and tightening and fixing the holder to the base member by means of one screw member, thus reducing the number of components and the number of assembly steps, but a mold structure for forming the engagement hole in the base member, which is to be molded, would become complicated, thus causing an increase in the cost.

The present invention has been accomplished in light of such circumstances, and it is an object thereof to provide an external handle device for a vehicle door that enables the number of components and the number of assembly steps to be reduced when fixing an electrical component to a base member and that also enables the cost to be reduced.

Means for Solving the Problems

In order to attain the above object, according to a first aspect of the present invention, there is provided an external handle device for a vehicle door, comprising an operating handle having a grip portion that is formed so as to be long and is disposed outside an outer panel forming part of a door having one end part pivotably supported on a vehicle body, a support member that is mounted on the door so as to pivotably support one end part of the operating handle, a base member that is made of a synthetic resin and is mounted on the door so as to correspond to the other end part of the operating handle, and a holder that is mounted on the base member so as to house and hold an electrical component, characterized in that a bottomed mounting hole is provided in a mounting portion provided integrally with the base member, the bottomed mounting hole being for mounting the mounting portion on an end wall on the other end side of the door and opening on the end wall side, an engagement hole extending in a direction along an axis of the mounting hole and having one end opening in a blocked part at an inner end of the mounting hole is provided in the mounting portion so that the other end thereof opens on an outer periphery of the mounting portion, and an engagement projection that engages with the other end part of the engagement hole is provided on the holder.

Further, according to a second aspect of the present invention, in addition to the first aspect, the electrical component is a switch that is turned ON/OFF by an operation of a vehicle user in order to show at least one of an intention to lock and an intention to unlock the door.

According to a third aspect of the present invention, in addition to the first aspect, the electrical component is a camera that takes an image of the outside of the vehicle or an approach sensor that detects the approach of a person.

According to a fourth aspect of the present invention, in addition to any one of the first to third aspects, the holder in a state in which the engagement projection is engaged with the engagement hole is secured to the base member by means of one securing member.

According to a fifth aspect of the present invention, in addition to any one of the first to third aspects, a seal member is fitted to a mounting face that is formed on the base member and faces the outer panel side, the seal member being held between the outer panel and the mounting face in a state in which the base member is mounted on the door, and an engagement ear portion is provided on the holder so as to be flush with the mounting face and protrude sideways from the holder, the engagement ear portion abutting against and engaging with the seal member from the side opposite to the outer panel.

According to a sixth aspect of the present invention, in addition to the fifth aspect, a holder receiving face and a positioning projection are provided on the base member, the holder receiving face abutting against the holder from the side opposite to a direction in which the outer panel abuts against the engagement ear portion via the seal member and the positioning projection protruding from the holder receiving face, and a fitting hole is provided in the holder, the positioning projection being fitted into the fitting hole.

According to a seventh aspect of the present invention, in addition to the first aspect, the holder has a peripheral wall portion surrounding the electrical component from the periphery, and a slit is provided in the peripheral wall portion, a harness being capable of being inserted through the slit, and the harness having one end part connected to the electrical component.

Furthermore, according to an eighth aspect of the present invention, in addition to the seventh aspect, a pair of the engagement projections are projectingly provided on the peripheral wall portion so as to sandwich the slit therebetween.

A second seal member 28 of an embodiment corresponds to the seal member of the present invention, a screw member 73 of the embodiment corresponds to the securing member of the present invention, and a front side door D of the embodiment corresponds to the door of the present invention.

Effects of the Invention

In accordance with the first to eighth aspects of the present invention, since the engagement hole, with which the engagement projection provided on the holder for holding the electrical component is engaged, is provided in the base member, when fixing the electrical component to the base member it is possible to decrease the number of screw members, thus reducing the number of components and the number of assembly steps. Moreover, since the engagement hole is provided in the mounting portion provided integrally with the base member so as to be mounted on the end wall on said other end side of the door having said one end part pivotably supported on the vehicle body, extends in the direction along the axis of the bottomed mounting hole of the mounting portion, and is formed so that one end opens in the blocked part at inner end of the mounting hole and the other end opens on the outer periphery of the mounting portion, it is possible to avoid the structure of a mold used when molding the base member becoming complicated, thus reducing the cost in combination with reducing the number of components and the number of assembly steps.

Furthermore, in accordance with the fourth aspect in particular, since the holder in which the engagement projection is engaged with the engagement hole is secured to the base member by means of one securing member, it is possible to minimize the components required for fixing an electrical component to the base member, thus reducing the number of components and the number of assembly steps.

In accordance with the fifth aspect in particular, since the seal member is fitted to the mounting face formed on the base member and facing the outer panel side, and the engagement ear portion abutting against and engaging with the seal member from the side opposite to the outer panel is provided on the holder so as to be flush with the mounting face, it is possible to provisionally assemble the holder on the base member before the base member is assembled on the door. Moreover, even if a force acts on the holder from outside the door, part of the force is received by the door panel to thus reduce the load acting on the portion of the holder mounted on the base member.**Furthermore, by sandwiching the seal member between the outer panel and the base member the occurrence of noise can be prevented, and when the base member is made of a metal it is possible to prevent the base member from coming into direct contact with outer panel, thus preventing metal-to-metal contact.

In accordance with the sixth aspect in particular, since the holder receiving face provided on the base member abuts against the holder from the side opposite to the direction in which the outer panel abuts against the engagement ear portion via the seal member, and the positioning projection protruding from the holder receiving face is fitted into the fitting hole provided in the holder, when provisionally assembling the holder on the base member by making the engagement ear portion of the holder, from the side opposite to the outer panel, abut against and engage with the seal member fitted on the mounting face of the base member, it is possible to reliably provisionally assemble the holder on the base member and, moreover, since the holder is sandwiched between the seal member and the holder receiving face, it is possible to fix the holder to the base member and the door in a state in which the base member is mounted on the door, and when fixing the holder to the base member it is unnecessary to use a securing member, thus further reducing the number of components.

In accordance with the seventh aspect in particular, since the slit is provided in the peripheral wall portion of the holder, which surrounds the electrical component from the periphery, the harness having one end part connected to the electrical component being capable of being inserted through the slit, even when a coupler is provided on the other end part of the harness or a portion of the harness projecting from the holder is clad with a cover, it is possible to facilitate the assembly of the electrical component having the harness connected thereto on the holder.

Furthermore, in accordance with the eighth aspect in particular, since the pair of engagement projections are projectingly provided on the peripheral wall portion so as to sandwich the slit therebetween, it is possible to flex the peripheral wall portion so that the two engagement projections move closer to or further away from each other, thus facilitating the operation of engaging the engagement projection with the engagement hole.

EXPLANATION OF REFERENCE NUMERALS AND SYMBOLS

Figure 1:
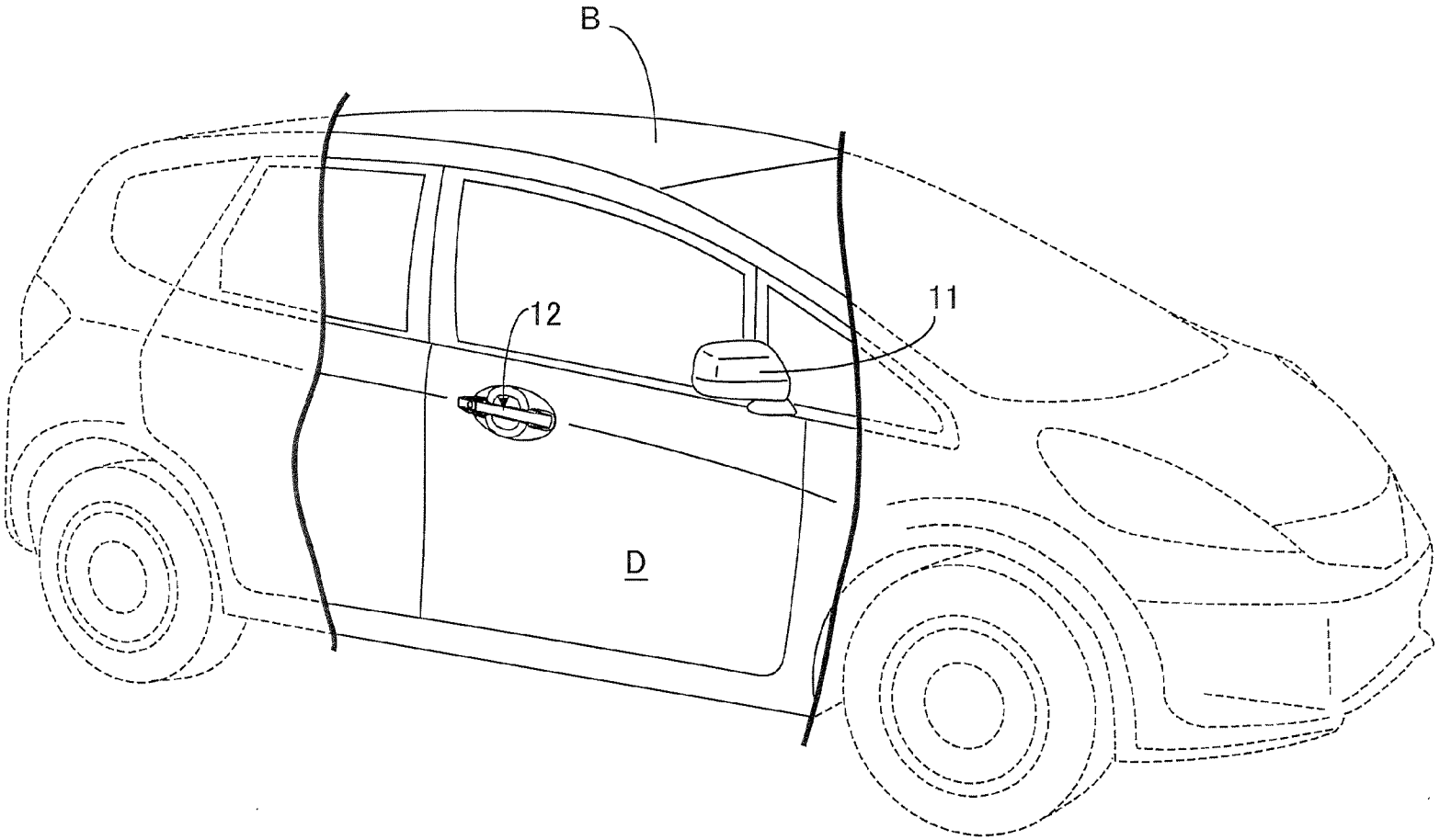
FIG. 1 is a perspective view of a passenger vehicle of a first embodiment. (first embodiment)

13 Operating handle
13*a* Grip portion
14 Support member
15 Base member
15*c* Mounting portion
16 Switch, which is an electrical component
17, 89 Holder
17*b* Peripheral wall portion
17*c*, 89*c* Engagement projection
17*e*, 89*e* Engagement ear portion
18 Outer panel
28 Second seal member, which is a seal member
33 Mounting hole
38 End wall
64 Harness
66 Engagement hole
68 Slit
71 Fitting hole
73 Screw member, which is a securing member
74 Mounting face

86 Holder receiving face
87 Positioning projection
90 Electrical component
B Vehicle body
D Front side door, which is a door

MODES FOR CARRYING OUT THE INVENTION

Modes for carrying out the present invention are explained below by reference to the attached drawings.

First Embodiment

A first embodiment of the present invention is explained by reference to FIG. 1 to FIG. 7. First, in FIG. 1, one end part (front end part) of a door, for example a front side door D, of this passenger vehicle is pivotably supported on a vehicle body B, and a door mirror 11 is disposed in a front part of the front side door D. Furthermore, an external handle device 12 in accordance with the present invention is mounted on the other end side, that is the rear end side, of the front side door D.

Figure 2:
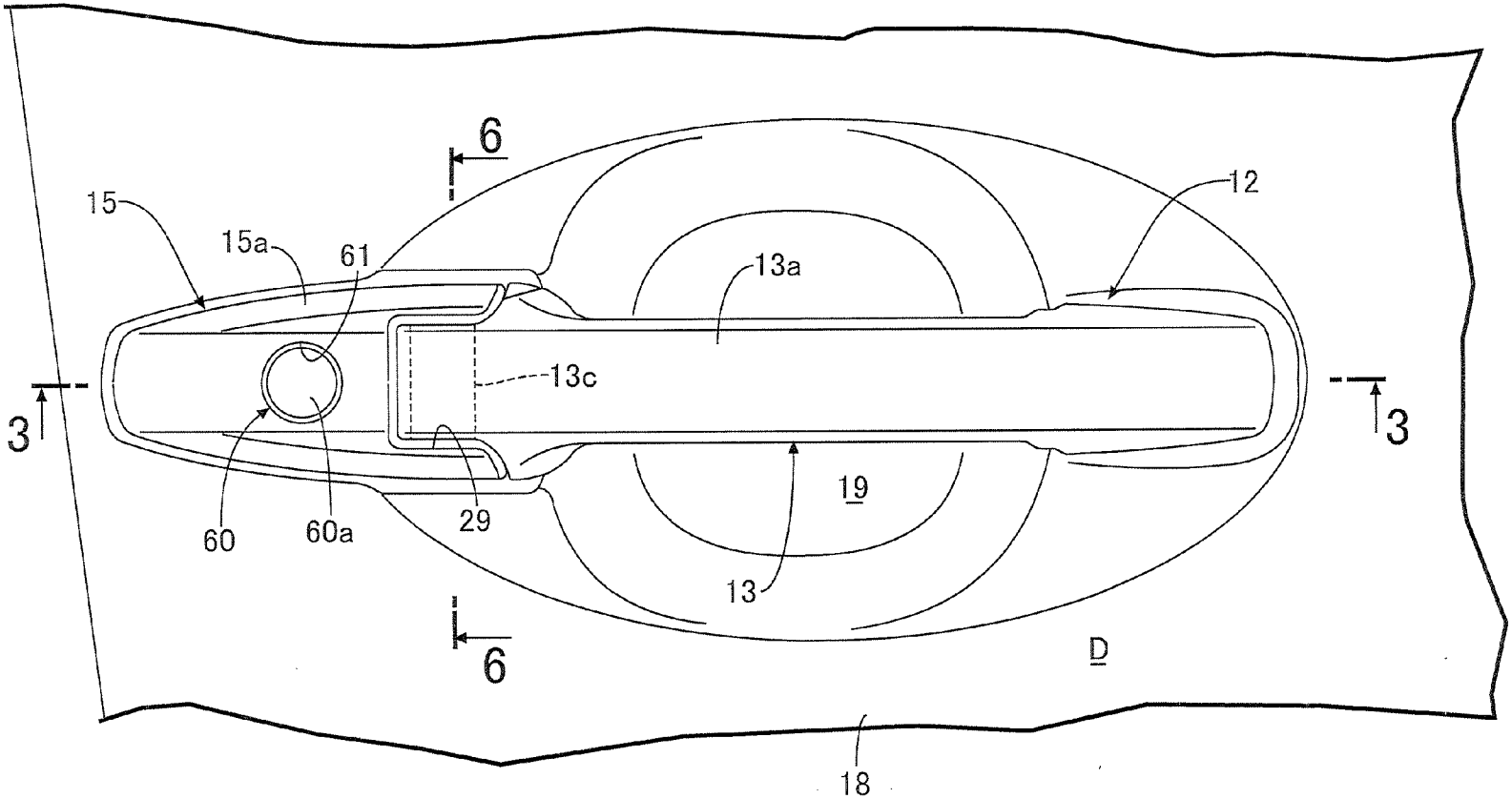
FIG. 2 is a side view showing an essential part of FIG. 1 in an enlarged manner. (first embodiment)
Figure 3:
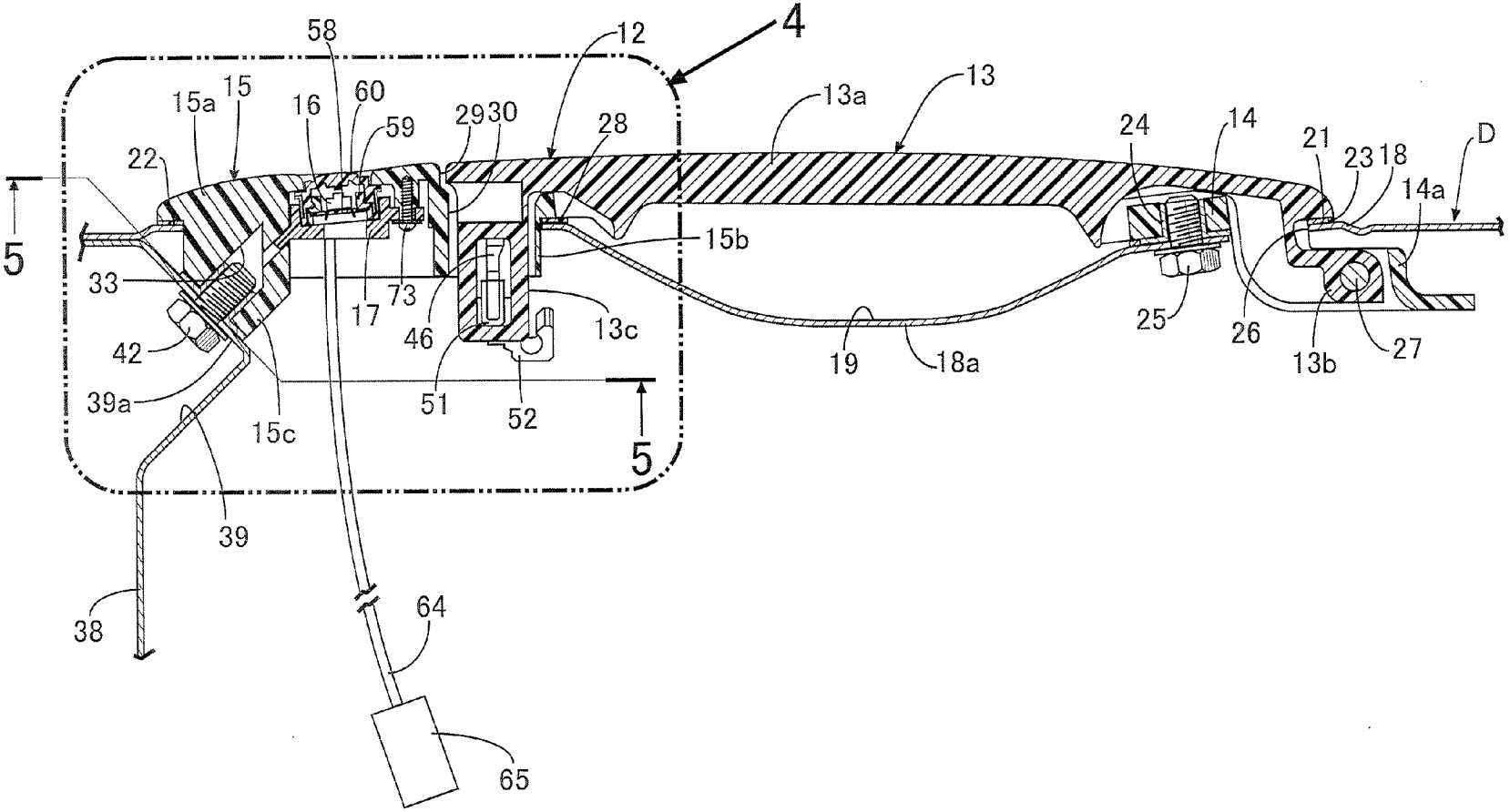
FIG. 3 is a sectional view along line 3-3 in FIG. 2. (first embodiment)

Referring in addition to FIG. 2 and FIG. 3, the external handle device 12 includes an operating handle 13, a support member 14 mounted on the front side door D so as to pivotably support one end part of the operating handle 13, a base member 15 made of a synthetic resin and mounted on the front side door D so as to correspond to the other end part of the operating handle 13, and a holder 17 mounted on the base member 15 so as to house and hold as an electrical component a switch 16 that is turned ON/OFF by an operation of a vehicle user in order to show at least one of an intention to lock and an intention to unlock the front side door D.

The operating handle 13 is pivotably supported on an outer panel 18 forming part of the front side door D, and is formed from a hard synthetic resin while having a grip portion 13*a* that is formed into a long shape so as to extend in the fore-and-aft direction of the vehicle (the left-and-right direction in FIG. 2) while enabling the vehicle user to grip it and is disposed outside the outer panel 18, a support arm portion 13*b* that is provided so as to be connected integrally to one end part of the grip portion 13*a* (a front end part along the fore-and-aft direction of the vehicle in this embodiment), and a guide arm portion 13*c* that is provided so as to be connected integrally to the other end part of the grip portion 13*a* (a rear end part along the fore-and-aft direction of the vehicle in this embodiment).

Furthermore, the support member 14, which is formed from a hard synthetic resin, is mounted on the outer panel 18 on one end side of the operating handle 13, and the base member 15, which is formed from a hard synthetic resin, is mounted on the outer panel 18 on the other end side of the operating handle 13.

A curved portion 18*a* is provided on the outer panel 18 so as to protrude inwardly in order to form a depression 19 that enables a hand of the vehicle user to be inserted between the grip portion 13*a* of the operating handle 13 and the outer panel 18, and first and second mounting seats 21 and 22 are provided on an outer face of the outer panel 18 at positions sandwiching the curved portion 18*a* from opposite sides to the front and to the rear along the fore-and-aft direction of the vehicle.

A thin flat plate-shaped first seal member 23 formed from a synthetic resin is disposed between the support member 14 and the first mounting seat 21. Moreover, a handle support portion 14*a* is provided integrally with the support member 14, the handle support portion 14*a* extending through the first seal member 23 and the outer panel 18 and being inserted inside the outer panel 18. Furthermore, a first nut 24 made of metal is embedded in a face of the support member 14 facing the outer panel 18, and by screwing into the first nut 24 a first bolt 25 inserted through the outer panel 18 from the inside and tightening, the support member 14 is mounted on the first mounting seat 21 of the outer panel 18.

The support arm portion 13*b* is bent into a substantially L-shaped form and is provided so as to be connected integrally to one end part of the grip portion 13*a*. A first through hole 26 for inserting the support arm portion 13*b* inside the outer panel 18 is provided in the first mounting seat 21 of the outer panel 18 and the support member 14. The support arm portion 13*b* disposed within the handle support portion 14*a* is pivotably supported on the handle support portion 14*a* via a support pin 27. That is, one end part of the operating handle 13 is pivotably supported on the outer panel 18 via the support member 14.

Figure 4:
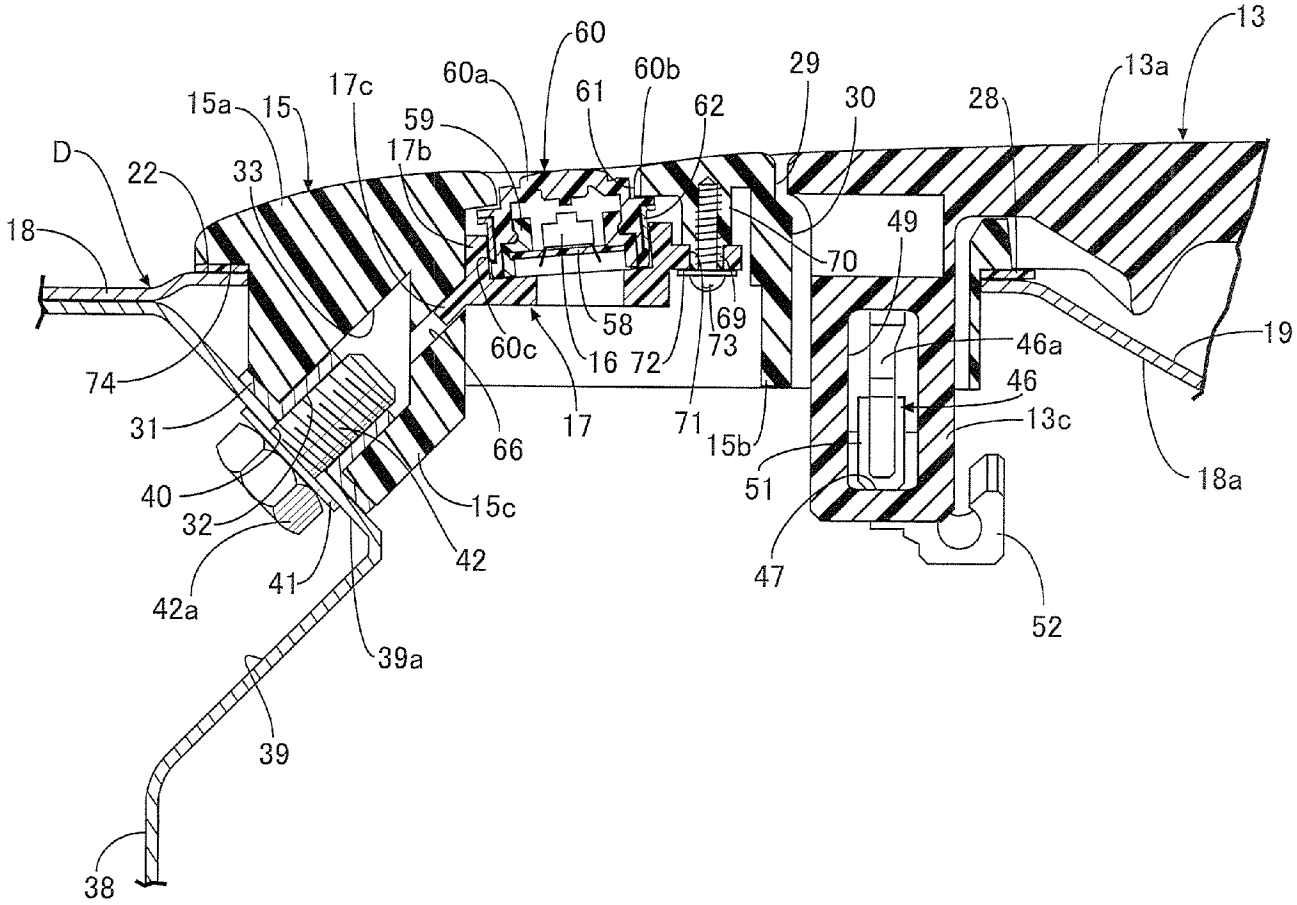
FIG. 4 is an enlarged view of a part shown by arrow 4 in FIG. 3. (first embodiment)
Figure 5:
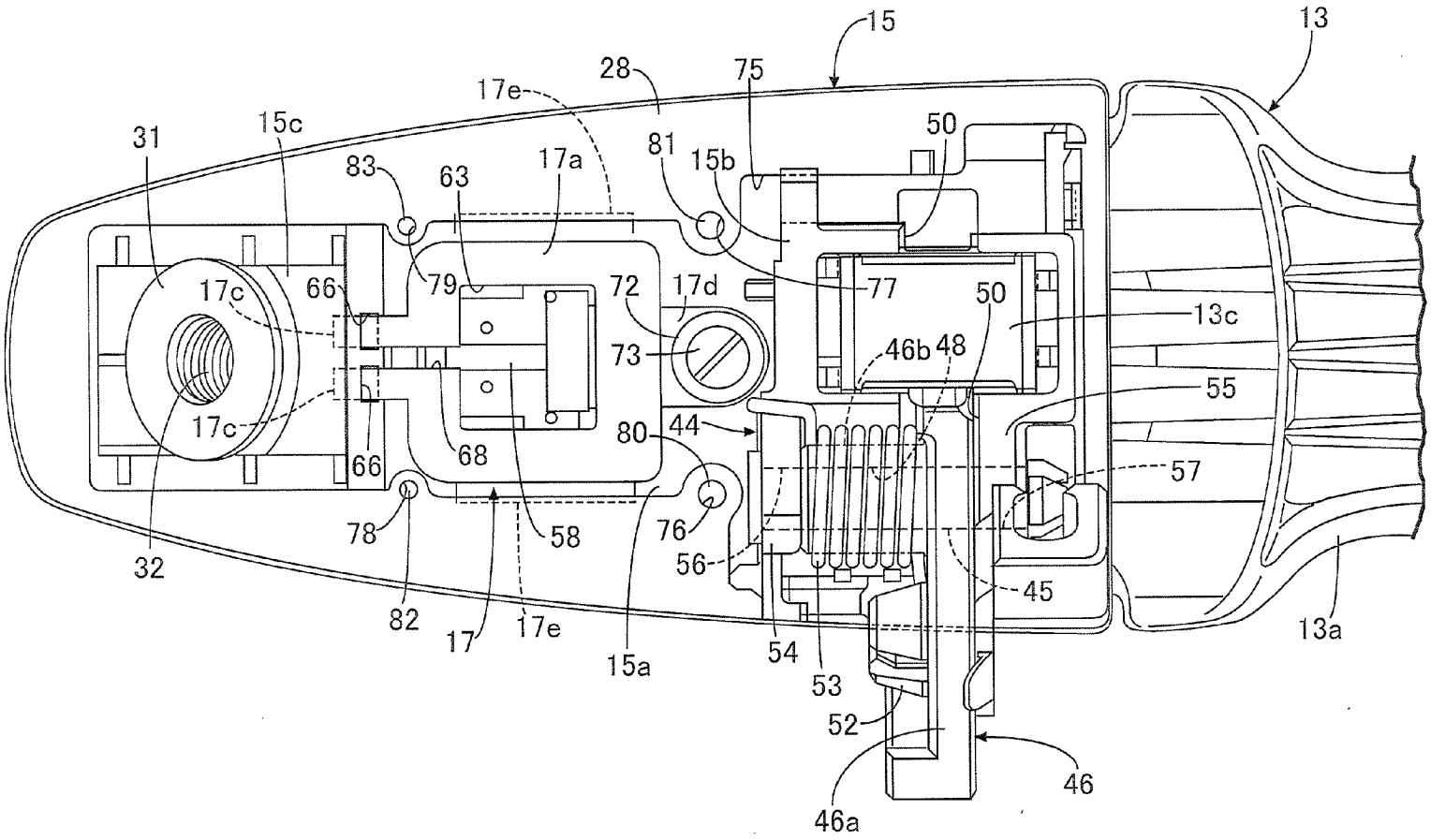
FIG. 5 is an enlarged view from arrowed line 5-5 in FIG. 3. (first embodiment)
Figure 6:
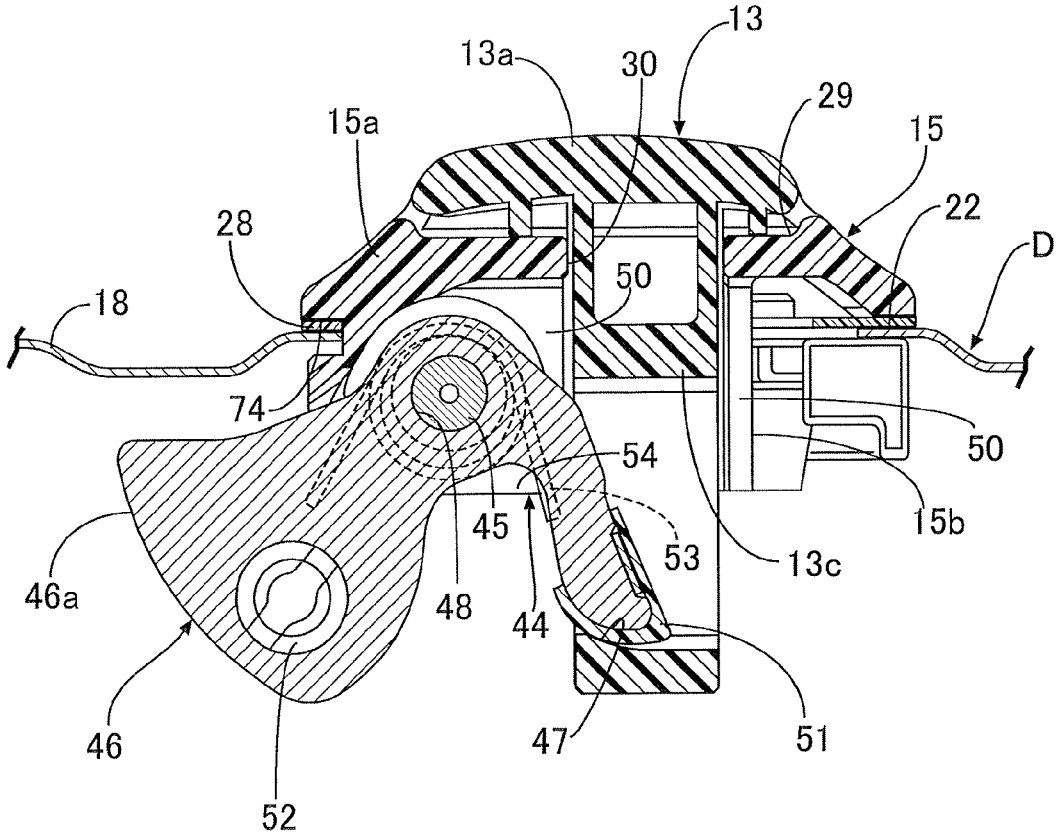
FIG. 6 is an enlarged sectional view along line 6-6 in FIG. 2. (first embodiment)

Referring in addition to FIG. 4 to FIG. 6, the base member 15 is formed from a hard synthetic resin, and integrally has a base member main portion 15*a* disposed on the outside of the second mounting seat 22 on the outer panel 18, a guide portion 15*b* extending inside the outer panel 18 from a front part of the base member main portion 15*a* so as to guide the guide arm portion 13*c* provided so as to be connected to the other end part of the grip portion 13*a* in the operating handle 13 at substantially right angles, and a mounting portion 15*c* extending inside the outer panel 18 from a rear part of the base member main portion 15*a*. A thin flat plate-shaped second seal member 28 formed from a resilient material such as a rubber or a synthetic resin is disposed between the second mounting seat 22 and at least a peripheral part of the base member main portion 15*a*.

Provided on an end part on the depression 19 side of the base member main portion 15*a* in the base member 15, that is a front end part, is a recess 29 for receiving the other end part of the grip portion 13*a*. The base member main portion 15*a* is thus formed into a shape that can give the impression that the grip portion 13*a* and the base member main portion 15*a* are integrated in a state in which the receiving recess 29 receives the other end part of the grip portion 13*a*. A rectangular insertion hole 30 into which the guide arm portion 13*c* is inserted is provided in the receiving recess 29 of the base member main portion 15*a*, and the guide portion 15*b* is formed into an angular tube shape while being connected to the insertion hole 30.

The mounting portion 15*c* is mounted on an end wall 38 at the other end side of the front side door D, that is, on the rear end side. Provided in the mounting portion 15*c* is a bottomed mounting hole 33 extending in a direction that obliquely intersects the outer panel 18 while having an axis that is inclined so as to move away from the outer panel 18 in going to the rear of the vehicle. A second nut 31 having a female thread 32 provided on its inner periphery is fixed to an open end part of the mounting hole 33 by press fitting.

On the other hand, provided in the end wall 38 on the rear end side of the front side door D is a recess 39 that is recessed forward in a part corresponding to the mounting portion 15*c*. The recess 39 is formed so as to have at a blocked end a support plate portion 39*a* that abuts against the tip of the mounting portion 15*c*, that is, the second nut 31. Provided in the support plate portion 39*a* is an insertion hole 40 corresponding to the second nut 31. A second bolt 42 having an enlarged diameter head portion 42*a* that engages with the support plate portion 39*a* via a washer 41 is inserted through the insertion hole 40, and by screwing the second bolt 42 into the second nut 31 and tightening, the base member 15 is mounted on the front side door D.

The guide arm portion 13*c*, which integrally includes the operating handle 13, is inserted into the guide portion 15*b* from the insertion hole 30 of the base member 15 so as to be movable in a direction substantially perpendicular to the outer panel 18. On the other hand, a lever support part 44 is provided integrally with the base member 15, a lever 46 is pivotably supported on the lever support part 44 via a support shaft 45 extending in the fore-and-aft direction of the vehicle so as to be perpendicular to the pivot axis of the operating handle 13, and the lever 46 engages with and abuts against an abutment face 47 provided on the guide arm portion 13*c*.

The lever 46 is formed so as to integrally have a crank-shaped lever main portion 46*a* and a support tubular portion 46*b* provided so as to be connected at right angles to one side face of an intermediate part of the lever main portion 46*a* while having the support shaft 45 inserted therethrough. A shaft hole 48 through which the support shaft 45 extends is provided in the support tubular portion 46*b* and the lever main portion 46*a*

The lever support part 44 is provided on the base member 15 so as to be connected to the guide portion 15*b*, and is formed from a pair of side walls 54 and 55 disposed on opposite sides of the lever 46 and having coaxially provided therein support holes 56 and 57 respectively for supporting by insertion thereinto opposite end parts of the support shaft 45 extending through the shaft hole 48 provided in the lever 46, the side walls 54 and 55 being provided integrally so as to be connected to the guide portion 15*b* at right angles.

One end part of the lever main portion 46*a* in the lever 46 is inserted into an opening 49 that is provided in the guide arm portion 13*c* of the operating handle 13 and opens on opposite sides on the left and right of the guide arm portion 13*c*. Slits 50 and 50 disposed on opposite sides of the opening 49 are provided in the angular tube-shaped guide portion 15*b* so as to extend in the axial direction of the guide portion 15*b*, and said one end part of the lever main portion 46*a* is inserted into the opening 49 via one slit 50.

The abutment face 47 is formed on one side wall of the opening 49 on the tip side of the guide arm portion 13*c* so as to face outward, and a lever cover 51 formed from a synthetic resin such as nylon having a low coefficient of friction is fitted onto one end part of the lever main portion 46*a* so as to be in contact with the abutment face 47.

A joint member 52 is fitted to the other end part of the lever main portion 46*a* in the lever 46, and one end part of a rod (not illustrated) for transmitting a door opening operating force to a latch mechanism (not illustrated) provided on the front side door D is linked to the joint member 52.

A return spring 53, which is a torsion spring surrounding the support tubular portion 46*b* of the lever 46, is provided between the lever 46 and the lever support part 44, one end part of the return spring 53 is engaged with the lever main portion 46*a* of the lever 46, and the other end part thereof is engaged with, among the pair of side walls 54 and 55 forming the lever support part 44, the side wall 54. The lever 46 having the lever cover 51 abutting against the abutment face 47 is urged by virtue of the spring force of the return spring 53 toward a non-operational position side, and the operating handle 13 is spring-biased by the return spring 53 toward an open position side.

When the operating handle 13 is in a non-operated state, the lever 46 is at the non-operational position shown in FIG. 6, and in this process a closed state of the front side door D is maintained by the latch mechanism. Furthermore, if the operating handle 13 is operated when the latch mechanism is in a latch-released state, due to operation of the guide arm portion 13*c* accompanying detachment of the other end part of the operating handle 13 from the receiving recess 29 of the base member 15, the lever 46 pivots in a counterclockwise direction from the position of FIG. 6. The latch mechanism thereby releases the closed state of the front side door D, thus enabling the front side door D to be opened by operation of the operating handle 13.

The holder 17 holding the switch 16 is fixed to an inner face side of the base member 15 between the guide portion 15*b* and the mounting portion 15*c*.

Focusing on FIG. 4, the switch 16 is disposed on a board 58, and the board 58 is fixed to a tubular switch case 59 housing the switch 16. Switching the switch 16 between ON and OFF is carried out by means of a switch button 60, and the switch button 60 is fitted onto the switch case 59 so as to cover the switch case 59. When a pushing operation portion 60*a* of the switch button 60 is pushed, the pushing operation portion 60*a* comes into resilient contact with the switch 16.

The switch button 60 is formed into a bottomed and, for example, rectangular tube shape from a resilient material so as to have the pushing operation portion 60*a* in a blocked part at one end, and an opening 61 that the pushing operation portion 60*a* faces is provided in the base member main portion 15*a* of the base member 15.

The switch button 60 is thus held between the switch case 59 and the base member 15, and a collar portion 60*b* opposing an inner face of the base member main portion 15*a* in the base member 15 at the peripheral edge of the opening 61 is formed on the switch button 60 so as to surround the pushing operation portion 60*a*.

Moreover, a tubular case cover 62 is fitted onto the outer periphery of the switch button 60, the case cover 62 enhancing the water resistance by preventing the switch button 60 from flexing more than necessary when the pushing operation portion 60*a* is pushed. The case cover 62 surrounding the switch button 60 is fitted onto the switch button 60 so that its movement in the axial direction is restricted by the collar portion 60*b* and an annular projecting portion 60*c* projectingly provided integrally with the outer periphery of the switch button 60.

The holder 17 integrally has a support plate portion 17*a* that receives the other ends of the switch case 59 supporting the switch 16 and the switch button 60 fitted to the switch case 59, and a peripheral wall portion 17*b* connectedly provided at right angles integrally with an outer peripheral part of the support plate portion 17*a* so as to surround the switch 16 from the periphery by fitting to and holding the other end side of the switch button 60.

A rectangular opening 63 that the board 58 faces is provided in the center of the support plate portion 17*a*. A harness 64 (see FIG. 3) having one end part connected to the board 58 is guided outside via the opening 63, and a coupler 65 is provided on the other end part of the harness 64. Furthermore, the peripheral wall portion 17*b* is formed into a rectangular tube shape so as to correspond to the switch button 60.

Engagement holes 66 and 66, for example a pair, extending in a direction along the axis of the mounting hole 33 and having one end opening in a blocked part at the inner end of the bottomed mounting hole 33 provided in the mounting portion 15*c* are provided in the mounting portion 15*c* of the base member 15 so that the other end opens on the outer periphery of the mounting portion 15*c*. Provided integrally with the holder 17 are a pair of engagement projections 17*c* and 17*c* each engaging with the other end parts of the engagement holes 66. Moreover, the engagement projections 17*c* are provided integrally with the holder 17 so as to protrude obliquely outward from an end part, on the support plate portion 17*a* side, of the peripheral wall portion 17*b*.

In the first embodiment, the center of the pair of engagement holes 66 is disposed at a position that is substantially coincident with the central axis of the mounting hole 33, but the center of the pair of engagement holes 66 may be disposed at a position displaced from the central axis of the mounting hole 33.

Furthermore, provided in the peripheral wall portion 17*b* of the holder 17 is a slit 68 through which the harness 64 can be inserted, and projectingly provided on the peripheral wall portion 17*b* so as to sandwich the slit 68 therebetween are the two engagement projections 17*c* and 17*c*.

Figure 7:
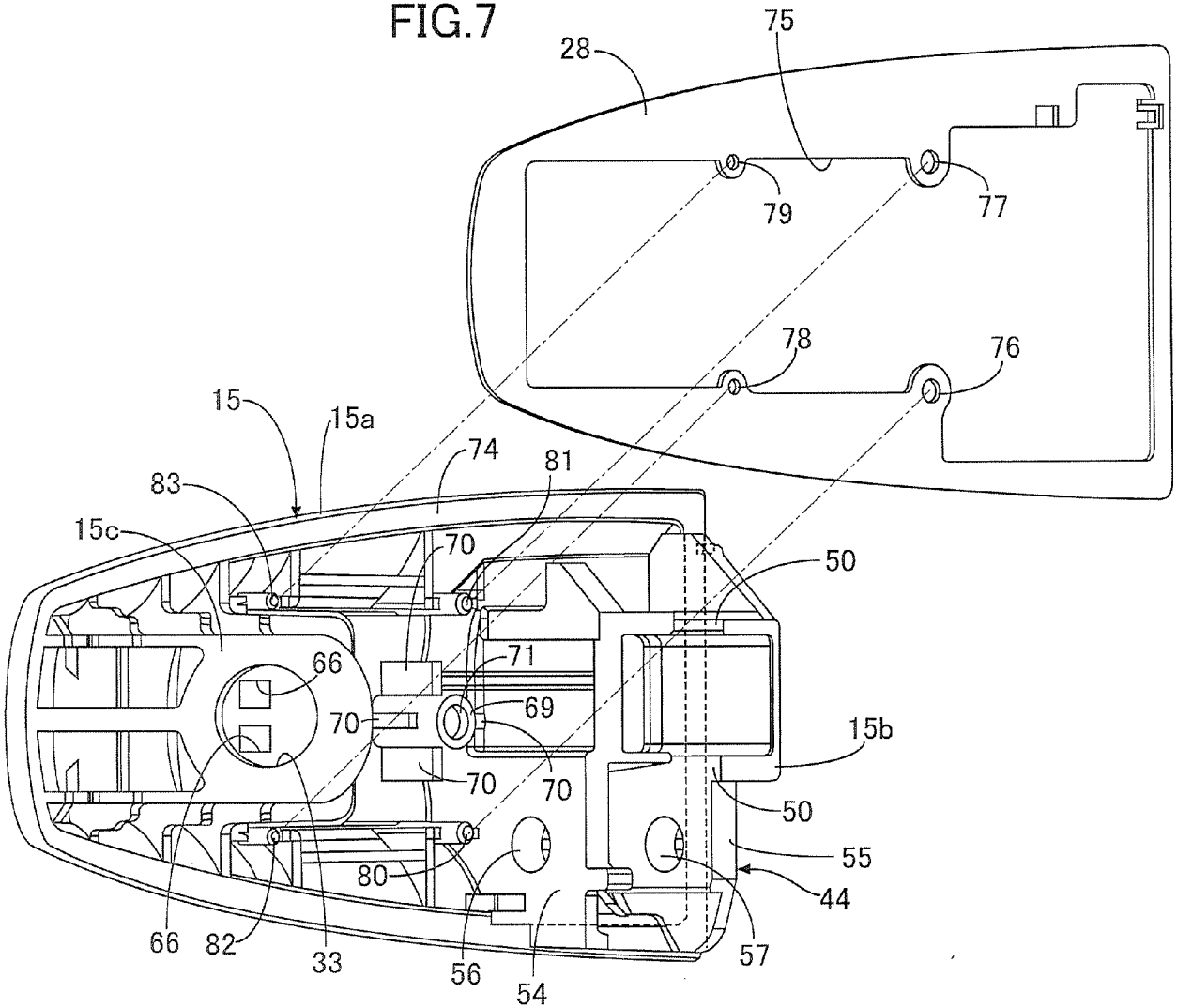
FIG. 7 is an exploded perspective view of a base member and a second seal member when a second nut is not fixed. (first embodiment)

Referring in addition to FIG. 7, a base end part of a cylindrical mounting boss 69 is provided at right angles so as to be connected integrally to the base member main portion 15*a* of the base member 15 at a position such that the peripheral wall portion 17*b* of the holder 17 is sandwiched between the mounting boss 69 and the mounting portion 15*c*. Provided so as to be connected integrally to an outer peripheral part, excluding an extremity part, of the mounting boss 69 are four ribs 70 disposed in a + shape so as to extend radially from the central axis of the mounting boss 69.

On the other hand, a supporting projection portion 17*d* having a fitting hole 71 into which an extremity part of the mounting boss 69 is fitted is provided integrally with the peripheral wall portion 17*b* of the holder 17 so as to protrude outward. In a state in which the supporting projection portion 17*d* having the extremity part of the mounting boss 69 inserted through the fitting hole 71 is received by the ribs 70, a screw member 73, which is a securing member that abuts against and engages with the supporting projection portion 17*d* via a washer 72, is screwed into the mounting boss 69. That is, the holder 17 having the engagement projections 17*c* and 17*c* engaged with the engagement holes 66 and 66 is secured to the base member 15 by means of one screw member 73.

Fitted to a mounting face 74 that is formed on the base member main portion 15*a* of the base member 15 and faces the second mounting seat 22 side of the outer panel 18 is the second seal member 28, which is held between the outer panel 18 and the mounting face 74 in a state in which the base member 15 is mounted on the front side door D.

The second seal member 28 is formed into a flat plate shape having in a central part a through hole 75 in which the guide portion 15*b*, the mounting portion 15*c*, the lever support part 44 and the holder 17 can be disposed, the guide portion 15*b*, the mounting portion 15*c*, and the lever support part 44 being provided on the base member 15, and the holder 17 being mounted on the base member 15. Fitting holes 76, 77, 78, and 79 are provided in a plurality, four in this embodiment, of locations spaced in the peripheral direction of the inner peripheral part of the through hole 75. Provided on the base member 15 are fitting projections 80, 81, 82, and 83 that are individually fitted into the fitting holes 76 to 79. By fitting each of the fitting projections 80 to 83 into the corresponding fitting holes 76 to 79 the second seal member 28 is fitted to the mounting face 74.

On the other hand, engagement ear portions 17*e* and 17*e* are projectingly provided integrally with upper and lower sides of the peripheral wall portion 17*b* of the holder 17 so as to be flush with the mounting face 74 and protrude sideways from the holder 17, the engagement ear portions 17*e* and 17*e* having extremity parts thereof abutting against and engaging with the second seal member 28 from the side opposite to the outer panel 18.

The operation of the first embodiment is now explained. Since the front side door D having one end part thereof pivotably supported on the vehicle body B has the mounting portion 15*c* mounted on the end wall 38 on the other end side, the mounting portion 15*c* is provided integrally with the base member 15, and the engagement projections 17*c* engaging with the engagement holes 66 provided in the mounting portion 15*c* are provided on the holder 17 housing and holding the switch 16, it is possible to decrease the number of screw members when fixing the switch 16 to the base member 15, thus reducing the number of components and the number of assembly steps.

Moreover, since the mounting portion 15*c* is provided integrally with the base member 15 while having the bottomed mounting hole 33 extending in the direction obliquely intersecting the outer panel 18 of the front side door D, and the engagement holes 66 are formed so as to extend in the direction along the axis of the mounting hole 33 and have one end opening in the blocked part at the inner end of the mounting hole 33 and the other end opening on the outer periphery of the mounting portion 15*c*, it is possible to avoid the structure of a mould used when molding the base member 15 becoming complicated, thus reducing the cost in combination with reducing the number of components and the number of assembly steps.

Furthermore, since the holder 17 in a state in which the engagement projections 17*c* are engaged with the engagement holes 66 is secured to the base member 15 by means of one screw member 73, it is possible to minimize the components required when fixing the switch 16 to the base member 15, thus reducing the number of components and the number of assembly steps.

Moreover, since the second seal member 28 held between the outer panel 18 and the mounting face 74 in a state in which the base member 15 is mounted on the front side door D is fitted to the mounting face 74 formed on the base member 15 and faces the outer panel 18 side, and the pair of upper and lower engagement ear portions 17*e* abutting against and engaging with the second seal member 28 from the side opposite to the outer panel 18 are provided on the holder 17 so as to be flush with the mounting face 74 and protrude sideways from the holder 17, it is possible to provisionally assemble the holder 17 and the base member 15 in a state in which the base member 15 is yet to be mounted on the front side door D.

Moreover, even if a force from the outside of the front side door D acts on the holder 17 due to the operation of the switch button 60, part of the force can be received by the outer panel 18, thus reducing the load acting on the part where the holder 17 is mounted on the base member 15, sandwiching the second seal member 28 between the outer panel 18 and the base member 15 enables the occurrence of noise to be prevented, and when the base member 15 is made of metal, it is possible to prevent the base member 15 from coming into direct contact with the outer panel 18, thus preventing metal-to-metal contact.

Furthermore, since the holder 17 has the peripheral wall portion 17*b* surrounding the switch 16 from the periphery, and the slit 68, through which the harness 64 connected to one end part of the switch 16 can be inserted, is provided in the peripheral wall portion 17*b*, even if the coupler 65 is provided on the other end part of the harness 64 or the harness 64 is clad with a cover in a part projecting from the holder 17, it is possible to facilitate assembly of the switch 16 and the holder 17 in a state in which the harness 64 is connected.

Moreover, since the pair of engagement projections 17*c* are projectingly provided on the peripheral wall portion 17*b* so as to sandwich the slit 68 therebetween, it is possible to flex the peripheral wall portion 17*b* so that the two engagement projections 17*c* move closer to or further away from each other, thus facilitating an operation of engaging the engagement projections 17*c* with the engagement holes 66.

In the first embodiment above, the second nut 31 is fixed by press fitting into the open end part of the mounting hole 33 of the mounting portion 15*c* of the base member 15, but a bolt may be mounted in the mounting hole 33 by thermal press fitting, and in this process the engagement holes 66 exhibit a function of allowing heat to escape from the mounting hole 33.

Second Embodiment

Figure 8:
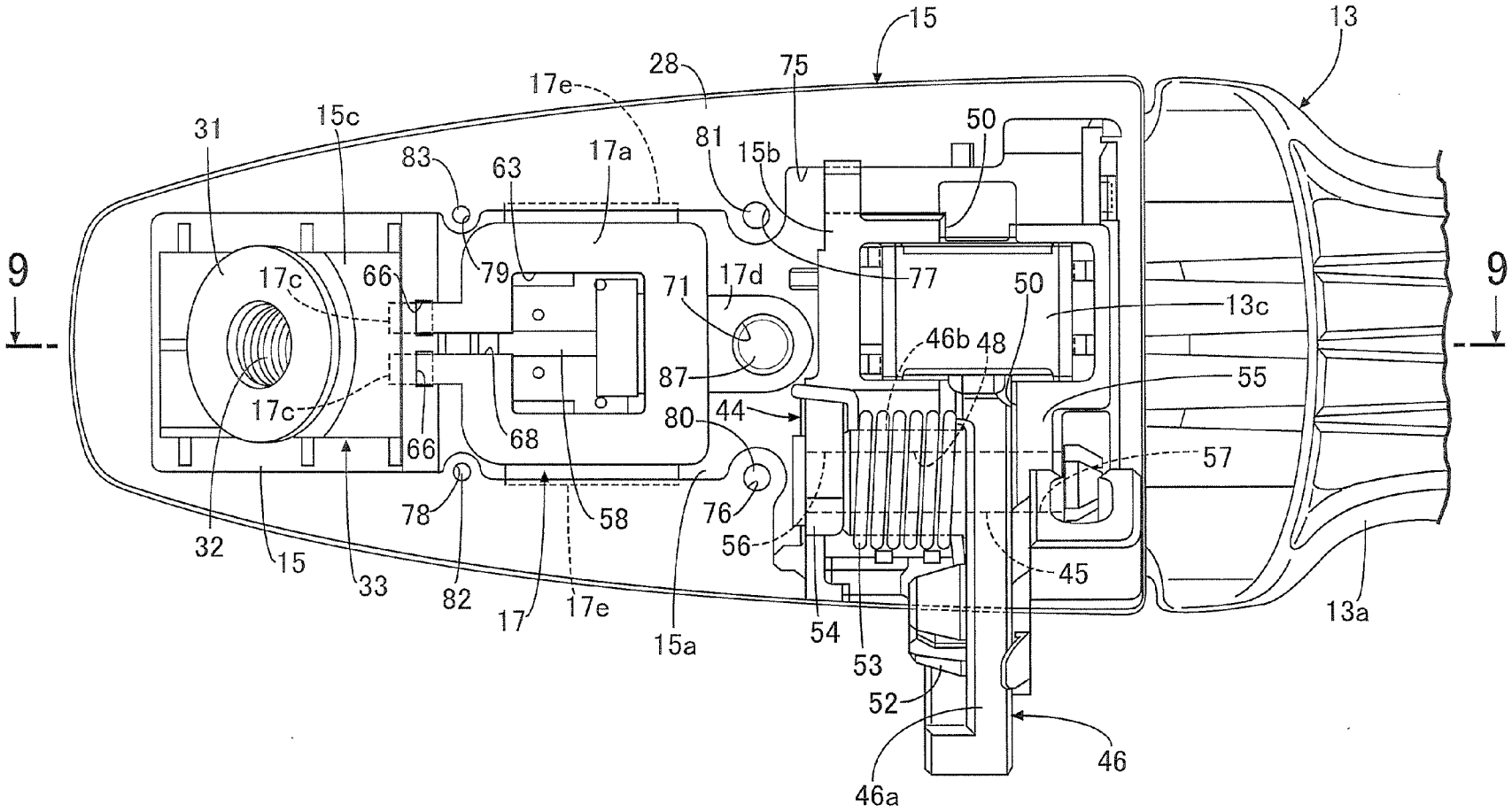
FIG. 8 is a view, corresponding to FIG. 5, of a second embodiment. (second embodiment)
Figure 9:
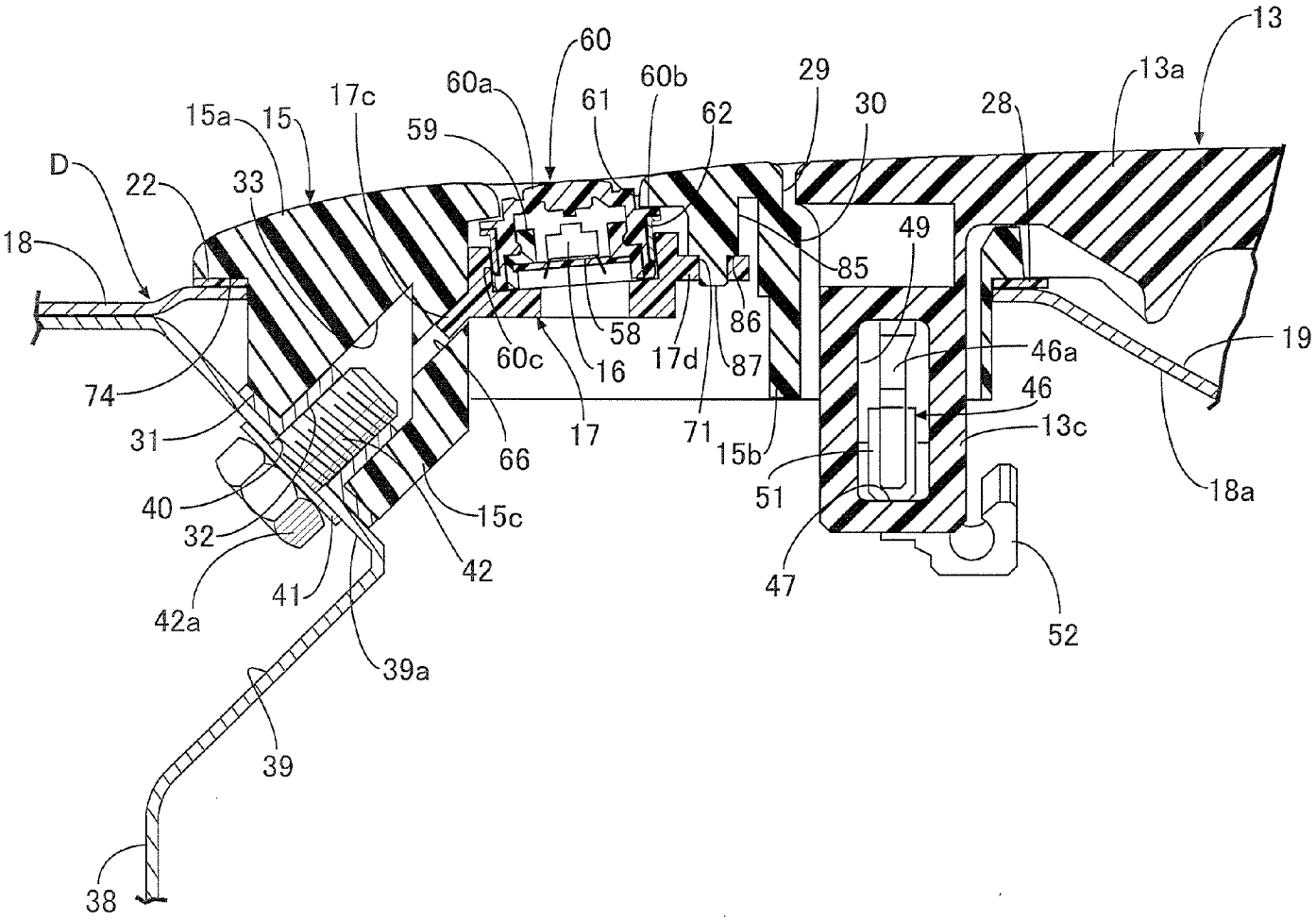
FIG. 9 is a sectional view along line 9-9 in FIG. 8. (second embodiment)

A second embodiment the present invention is now explained by reference to FIG. 8 and FIG. 9; parts corresponding to those of the first embodiment are denoted by the same reference numerals and symbols and are only shown in the figures, duplication of the detailed explanation therefore being omitted.

The holder 17 holding a switch 16 is disposed between the guide portion 15*b* and the mounting portion 15*c* of the base member 15, and a pair of engagement projections 17*c* of the holder 17 are engaged with engagement holes 66 provided in the mounting portion 15*c* of the base member 15 in the same manner as in the first embodiment.

A columnar boss 85 is provided integrally with a base member main portion 15*a* of the base member 15 at a position corresponding to a supporting projection portion 17*d* provided on the holder 17 on the side opposite to the mounting portion 15*c*. An extremity part of the boss 85 forms a holder receiving face 86 that carries out abutment from the side opposite to the direction in which the outer panel 18 abuts against the engagement ear portions 17*e* via a second seal member 28. Furthermore, a positioning projection 87 is coaxially provided on the boss 85. The positioning projection 87 projects from the holder receiving face 86 and is fitted into a fitting hole 71 of the support plate portion 17*d*.

In accordance with the second embodiment, when the holder 17 is provisionally assembled on the base member 15 by making the engagement ear portions 17*e* of the holder 17 abut against and engage with the second seal member 28, fitted to the mounting face 74 of the base member 15, from the side opposite to the outer panel 18, the holder 17 can more reliably be provisionally assembled on the base member. Moreover, since the holder 17 is sandwiched between the second seal member 28 and the holder receiving face 86, in a state in which the base member 15 is mounted on the front side door D the holder 17 can be fixed to the base member 15 and the front side door D, and it is unnecessary to use a securing member when fixing the holder 17 to the base member 15, thus further reducing the number of components.

Third Embodiment

Figure 10:
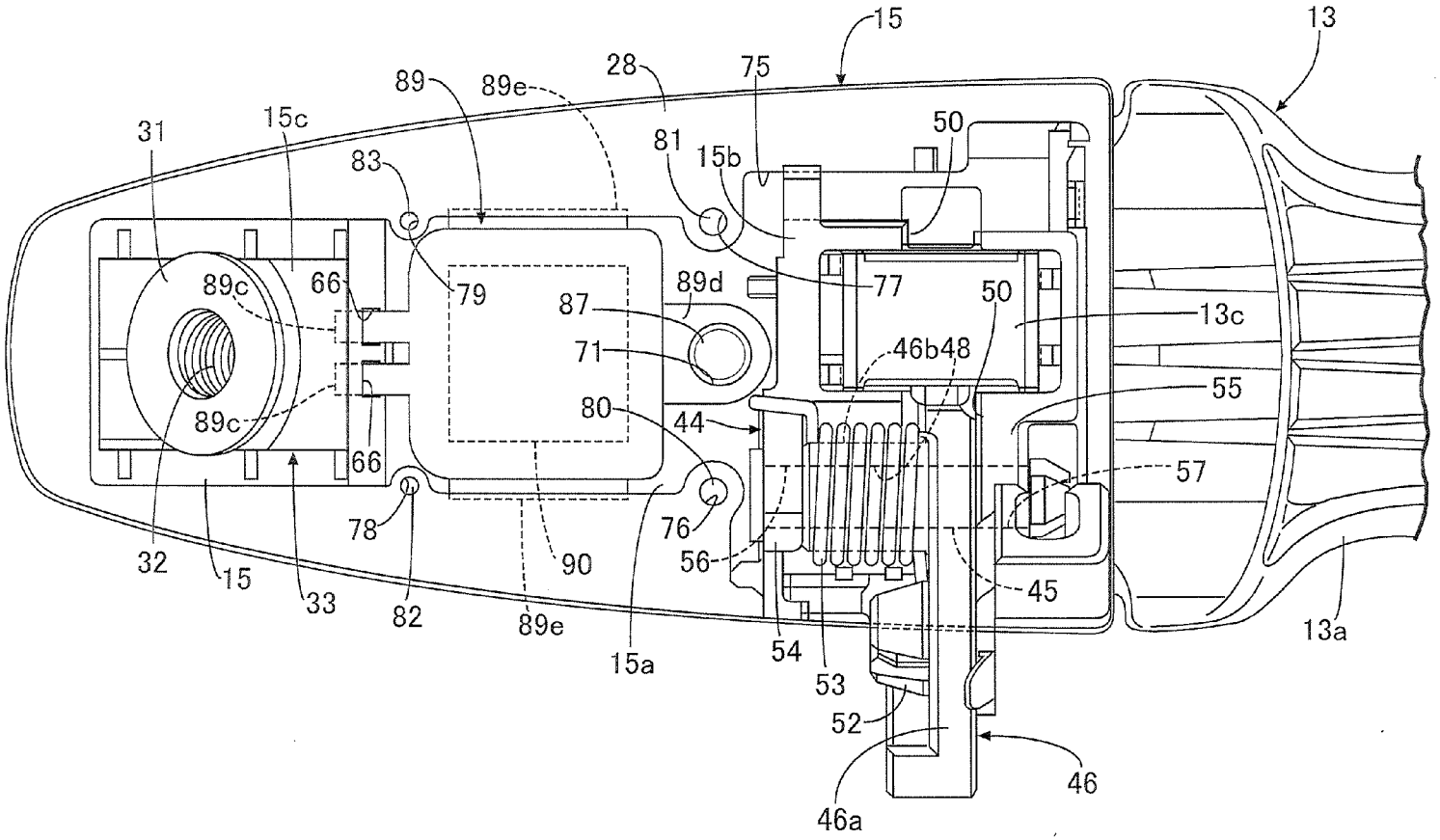
FIG. 10 is a view, corresponding to FIG. 5, of a third embodiment. (third embodiment)

FIG. 10 shows a third embodiment of the present invention; parts corresponding to those of the first and second embodiments are denoted by the same reference numerals and symbols and are only shown in the figures, duplication of the detailed explanation therefore being omitted.

A holder 89 housing and holding an electrical component 90 is disposed between the guide portion 15*b* and the mounting portion 15*c* of the base member 15, and a pair of engagement projections 89*c* of the holder 89 are engaged with engagement holes 66 provided in the mounting portion 15*c* in the base member 15 in the same manner as in the first and second embodiments.

The holder 89 integrally has a supporting projection portion 89*d* having a fitting hole 71 and being disposed on the side opposite to the mounting portion 15*c*, and integrally has engagement ear portions 89*e* and 89*e* on upper and lower sides, extremity parts of the engagement ear portions 89*e* and 89*e* abutting against and engaging with a second seal member 28 from the side opposite to the outer panel 18 (see the first and second embodiments).

In the same manner as in the second embodiment above, a holder receiving face 86 provided on the base member 15 abuts against the supporting projection portion 89*d* from the side opposite to the direction in which the outer panel 18 abuts against the engagement ear portions 89*e* via the second seal member 28. A positioning projection 87 protruding from the holder receiving face 86 is fitted into a fitting hole 71 provided in the supporting projection portion 89*d*.

The electrical component 90 is for example a camera that takes an image outside the vehicle or an approach sensor that detects a person approaching.

In accordance with the third embodiment, the same effects as those of the second embodiment above can also be exhibited.

Embodiments of the present invention are explained above, but the present invention is not limited to the embodiments above and may be modified in a variety of ways as long as the modifications do not depart from the spirit and scope thereof.

The invention claimed is:

1. An external handle device for a vehicle door, comprising an operating handle having a grip portion that is formed so as to be long and is disposed outside an outer panel forming part of a door having one end part pivotably supported on a vehicle body, a support member that is mounted on the door so as to pivotably support one end part of the operating handle, a base member that is made of a synthetic resin and is mounted on the door so as to correspond to another end part of the operating handle, and a holder that is mounted on the base member so as to house and hold an electrical component, wherein a bottomed mounting hole is provided in a mounting portion provided integrally with the base member, the bottomed mounting hole is for mounting the mounting portion on an end wall on another end of the door, and the bottomed mounting hole opens on an end wall side and has a closed inner blocked part, at least one engagement hole being formed through the closed inner blocked part so as to extend in a direction along an axis of the mounting hole, the at least one engagement hole having one end opening to the closed inner blocked part of the mounting hole, at least one engagement hole is provided with another end that opens on an outer periphery of the mounting portion, and at least one engagement projection is provided on the holder so as to engage with said other end of the at least one engagement hole.

2. The external handle device for a vehicle door according to claim 1, wherein the electrical component is a switch that is turned ON/OFF by an operation of a vehicle user in order to show at least one of an intention to lock and an intention to unlock the door.

3. The external handle device for a vehicle door according to claim 1, wherein the electrical component is a camera that takes an image of the outside of the vehicle or an approach sensor that detects the approach of a person.

4. The external handle device for a vehicle door according to claim 1, wherein the holder, in a state in which the at least one engagement projection is engaged with the at least one engagement hole, is secured to the base member by means of a fastener.

5. The external handle device for a vehicle door according to claim 1, wherein a seal member is fitted to a mounting face that is formed on the base member and faces the outer panel, the seal member being held between the outer panel and the mounting face in a state in which the base member is mounted on the door, and an engagement ear portion is provided on the holder so as to be flush with the mounting face and protrude sideways from the holder, the engagement ear portion abutting against and engaging with the seal member from a side opposite to the outer panel.

6. The external handle device for a vehicle door according to claim 5, wherein a holder receiving face and a positioning projection are provided on the base member, the holder receiving face abutting against the holder from a side opposite to a direction in which the outer panel abuts against the engagement ear portion via the seal member and in a direction in which the positioning projection protrudes from the holder receiving face, and a fitting hole is provided in the holder, the positioning projection being fitted into the fitting hole.

7. The external handle device for a vehicle door according to claim 1, wherein the holder has a peripheral wall portion surrounding the electrical component, and a slit is provided in the peripheral wall portion, a harness being capable of being inserted through the slit, and the harness having one end part connected to the electrical component.

8. The external handle device for a vehicle door according to claim 7, wherein the at least one engagement projection comprises a pair of the engagement projections that are projectingly provided on the peripheral wall portion to form the slit therebetween.

9. The external handle device for a vehicle door according to claim 2, wherein the holder, in a state in which the at least one engagement projection is engaged with the at least one engagement hole, is secured to the base member by means of a fastener.

10. The external handle device for a vehicle door according to claim 3, wherein the holder, in a state in which the at least one engagement projection is engaged with the at least one engagement hole is secured to the base member by means of a fastener.

11. The external handle device for a vehicle door according to claim 2, wherein a seal member is fitted to a mounting face that is formed on the base member and faces the outer panel, the seal member being held between the outer panel and the mounting face in a state in which the base member is mounted on the door, and an engagement ear portion is provided on the holder so as to be flush with the mounting face and protrude sideways from the holder, the engagement ear portion abutting against and engaging with the seal member from a side opposite to the outer panel.

12. The external handle device for a vehicle door according to claim 3, wherein a seal member is fitted to a mounting face that is formed on the base member and faces the outer panel, the seal member being held between the outer panel and the mounting face in a state in which the base member is mounted on the door, and an engagement ear portion is provided on the holder so as to be flush with the mounting face and protrude sideways from the holder, the engagement ear portion abutting against and engaging with the seal member from aside opposite to the outer panel.

13. An external handle device for a vehicle door, comprising an operating handle having a grip portion that is formed so as to be long and is disposed outside an outer panel forming part of a door having one end part pivotably supported on a vehicle body, a support member that is mounted on the door so as to pivotably support one end part of the operating handle, a base member that is made of a synthetic resin and is mounted on the door so as to correspond to another end part of the operating handle, and a holder that is mounted on the base member so as to house and hold an electrical component, the holder having a peripheral wall portion surrounding the electrical component, and a slit is provided in the peripheral wall portion, wherein a harness is inserted through the slit, and the harness having one end part connected to the electrical component, wherein a bottomed mounting hole is provided in a mounting portion provided integrally with the base member, the bottomed mounting hole for mounting the mounting portion on an end wall on an end of the door, the bottomed mounting hole opening on an end wall side, and having a closed inner blocked part, and at least one engagement hole being formed through the closed inner blocked part so as to extend in a direction along an axis of the mounting hole, the at least one engagement hole having one end opening to the closed inner blocked part of the mounting hole, and at another end thereof, the at least one engagement hole opens on an outer periphery of the mounting portion, and at least one engagement projection is provided on the holder so as to engage with said other end of the at least one engagement hole;

wherein said electrical component is one of: a camera that takes an image of the outside of the vehicle; a switch that is turned ON/OFF by an operation of a vehicle user in order to show at least one of an intention to lock and an intention to unlock the door; and an approach sensor that detects the approach of a person.

14. An external handle device for a vehicle door according to claim 13, wherein the electrical component is a camera that takes an image of the outside of the vehicle.

15. The external handle device for a vehicle door according to claim 13, wherein a seal member is fitted to a mounting face that is formed on the base member and faces the outer panel, the seal member being held between the outer panel and the mounting face in a state in which the base member is mounted on the door, and an engagement ear portion is provided on the holder so as to be flush with the mounting face and protrude sideways from the holder, the engagement ear portion-abutting against and engaging with the seal member from a side opposite to the outer panel.

16. The external handle device for a vehicle door according to claim 15, wherein a holder receiving face and a positioning projection are provided on the base member, the holder receiving face abutting against the holder from a side opposite to a direction in which the outer panel abuts against the engagement ear portion via the seal member and in a direction in which the positioning projection protrudes from the holder receiving face, and a fitting hole is provided in the holder, the positioning projection being fitted into the fitting hole.

17. An external handle device for a vehicle door, comprising:

an operating handle having a grip portion that is formed so as to be long and is disposed outside an outer panel forming part of a door having one end part pivotably supported on a vehicle body, a support member that is mounted on the door so as to pivotably support one end part of the operating handle, a base member that is made of a synthetic resin and is mounted on the door so as to correspond to another end part of the operating handle, a seal member that is fitted to a mounting face that is formed on the base member and faces the outer panel, and a holder that is mounted on the base member so as to house and hold an electrical component, the holder having a peripheral wall portion surrounding the electrical component, and a slit is provided in the peripheral wall portion, wherein a harness is inserted through the slit, and the harness having one end part connected to the electrical component, wherein a holder receiving face and a positioning projection are provided on the base member, the holder receiving face abutting against the holder from a side opposite to a direction in which the outer panel abuts against an engagement ear portion provided on the holder via the seal member and abutting against the holder in a direction in which the positioning projection protrudes from the holder receiving face wherein the holder is secured to the base member by the positioning projection, and wherein a bottomed mounting hole is provided in a mounting portion provided integrally with the base member, the bottomed mounting hole for mounting the mounting portion on an end wall of the door, and having a closed inner blocked part, at least one engagement hole being formed through the closed inner blocked part so as to extend in a direction along an axis of the mounting hole, the at least one engagement hole having one end opening to the inner blocked part of the mounting hole and at another end thereof, the at least one engagement hole opening on an outer periphery of the mounting portion, and at least one engagement projection that is provided on the holder so as to engage with said other end of the at least one engagement hole, and in a state in which the at least one engagement projection is engaged with the at least one engagement hole; and wherein said electrical component is one of: a camera that takes an image of the outside of the vehicle; a switch that is turned ON/OFF by an operation of a vehicle user in order to show at least one of an intention to lock and an intention to unlock the door; and an approach sensor that detects the approach of a person.

* * * * *